United States Patent [19]

Hwang

[11] Patent Number: 4,956,884

[45] Date of Patent: Sep. 18, 1990

[54] MODULAR BOX SPRING MATTRESS

[76] Inventor: Dye-Shuh Hwang, 237, Cherng-Ming St., Kaoshung, Taiwan

[21] Appl. No.: 273,448

[22] Filed: Nov. 18, 1988

[51] Int. Cl.[5] ..... A47C 23/04

[52] U.S. Cl. ..... 5/246; 5/258; 5/477; 5/259.1; 267/179

[58] Field of Search ..... 267/166, 179; 5/477, 5/475, 248, 439, 259 R, 259 B, 260, 258, 246, 448

[56] References Cited

U.S. PATENT DOCUMENTS

| | | | |
|---|---|---|---|
| 16,254 | 12/1856 | Wright | 5/258 |
| 394,578 | 12/1888 | Johnson | 5/258 |
| 981,735 | 1/1911 | Young | 5/260 |
| 1,944,614 | 1/1934 | Salmon | 5/258 |
| 4,122,568 | 10/1978 | Bastos et al. | 5/448 |
| 4,254,978 | 3/1981 | Eshelman | 267/179 |
| 4,476,595 | 10/1984 | Ikeda | 5/267 |

FOREIGN PATENT DOCUMENTS

| | | | |
|---|---|---|---|
| 264276 | 4/1988 | European Pat. Off. | 267/179 |
| 120690 | 1/1927 | Switzerland | 5/258 |
| 202802 | 8/1923 | United Kingdom | 5/258 |
| 243915 | 12/1925 | United Kingdom | 5/258 |
| 509461 | 7/1939 | United Kingdom | 5/258 |

*Primary Examiner*—Eric K. Nicholson

*Attorney, Agent, or Firm*—Townsend and Townsend

[57] ABSTRACT

A modular box spring mattress includes two flexible plate units each of which consists of a plurality of plate subunits. The plate subunits of either of the plate units include a plurality of annular flanges which extend toward the adjoining plate unit. The annular flanges of one of the plate units respectively oppose the annular flanges of the adjoining plate unit so that the end turns of the compression springs are received within the annular flanges. Each of the annular flanges includes a plurality of flexible retaining arms extending obliquely and inwardly therefrom in a plane generally parallel to the plate subunits. The end portions of the retaining arms are spaced apart from the corresponding plate subunits so that the end turns of the compression springs can be respectively retained between the retaining arms and the plate subunits.

7 Claims, 4 Drawing Sheets

MODULAR BOX SPRING MATTRESS

BACKGROUND OF THE INVENTION

This invention relates to box spring mattresses, more particularly to a modular box spring mattress.

Because conventional box spring mattresses are usually produced as one integral unit, it is difficult to clean them. Furthermore, if an internal part of this kind of spring mattress is damaged, no replacement of the part can be made and a new spring mattress must be bought. To solve these shortcomings, I invented a combination spring mattress which is disclosed in my U.S. Pat. application No. 155,657, now abandoned. However, this combination spring mattress is complicated in construction and has numerous parts therefore causing high manufacturing costs and difficulty in assembly and disassembly.

SUMMARY OF THE INVENTION

The main object of this invention is to provide an inexpensive modular box spring mattress which has a small number of parts.

Another object of this invention is to provide a modular box spring mattress which can be both easily cleaned and repaired.

According to this invention, a modular box spring mattress includes two flexible plate units and a spring unit interposed between the plate units for biasing the plate units to move away from each other. The spring unit consists of a plurality of coiled compression springs. Either of the plate units comprises a plurality of plate subunits which are joined together side by side. The plate subunits of either of the plate units include a plurality of annular flanges which extend toward the adjoining plate unit. The annular flanges of one of the plate units respectively oppose the annular flanges of the adjoining plate unit so that the end turns of the compression springs are received within the annular flanges. Each of the annular flanges includes a plurality of flexible retaining arms extending obliquely and inwardly therefrom in a plane generally parallel to the plate subunits. The end portions of the retaining arms are spaced apart from the corresponding plate subunits so that the end turns of the compression springs can be respectively retained between the retaining arms and the plate subunits.

BRIEF DESCRIPTION OF THE DRAWINGS

Other features and advantages of this invention will become apparent in the following detailed description of a preferred embodiment of this invention, with reference to the accompanying drawings, in which.

DETAILED DESCRIPTION OF THE PREFERRED EMBODIMENT

Figure 1:
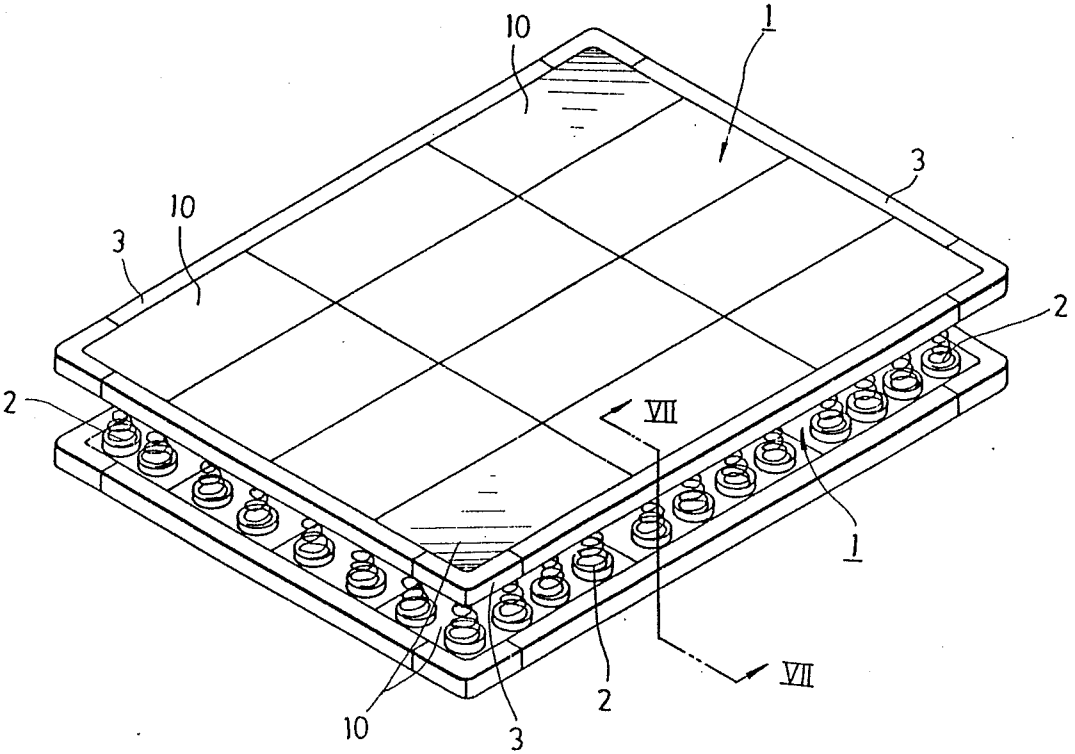
FIG. 1 is a perspective view of a modular box spring mattress according to this invention.

Referring to FIG. 1, a modular box spring mattress of this invention includes upper and lower generally rectangular plate units 1 and a plurality of coiled compression springs 2 interposed between the plate units 1. Either of the plate units 1 consists of a plurality of generally rectangular plate subunits 10. A plurality of marginal strips 3 are provided along the periphery of either of the plate units 1 to form a loop around the same.

Figure 2:
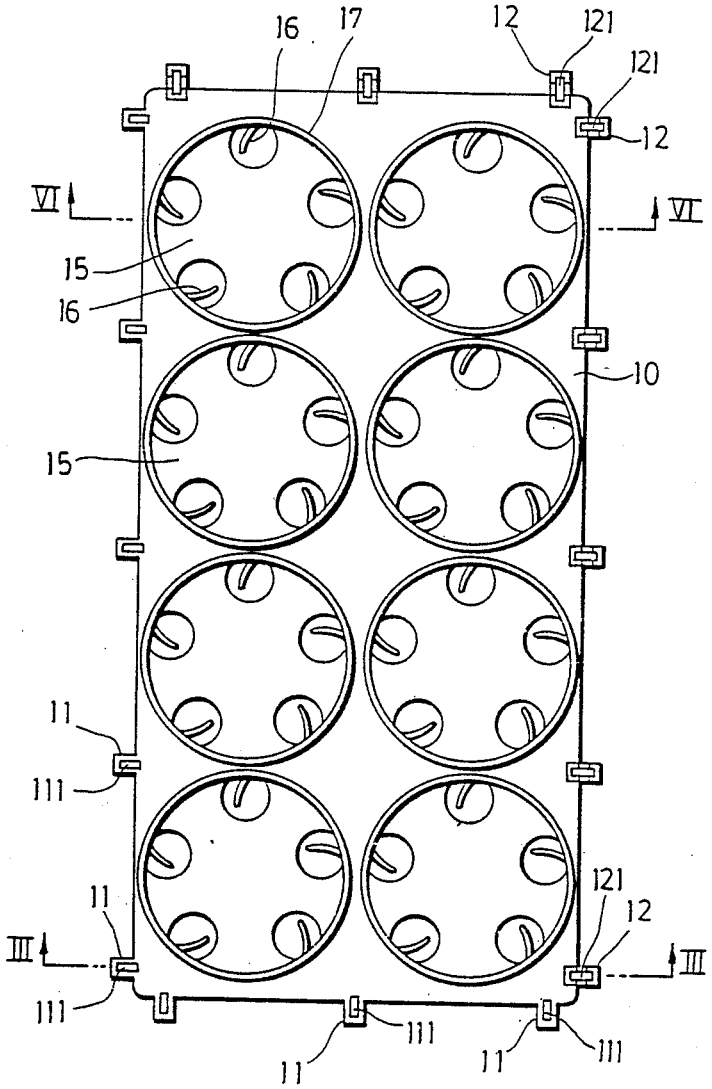
FIG. 2 is a plan view of the sub-unit of the modular box spring mattress of this invention.

Referring to FIG. 2, each of the plate subunits 10 is made of plastic and includes several insertion members 11 secured to two adjacent sides thereof and several coupling seats 12 provided on another two adjacent sides of the plate subunit 10. As illustrated, each of the insertion members 11 opposes one of the coupling seats 12.

Figure 3:
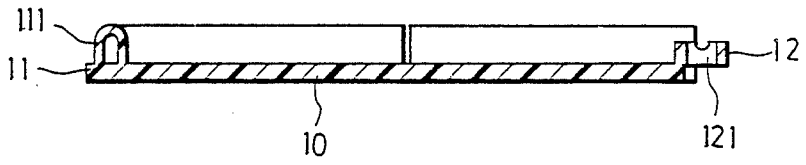
FIG. 3 is a sectional view taken along line III—III in FIG. 2.

Referring to FIG. 3, each of the insertion members 11 has a looped vertical portion 111, while each of the coupling seats 12 has a retaining hole 121 formed therein. Both the insertion members 11 and the coupling seats 12 are integrally formed with the plate subunit 10.

Figure 4:
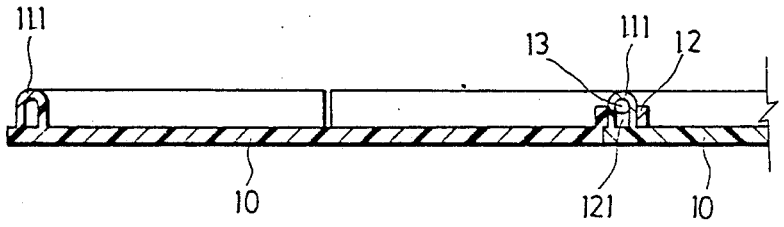
FIG. 4 is a schematic sectional view illustrating how to join two adjacent plate subunits together in accordance with this invention.
Figure 5:
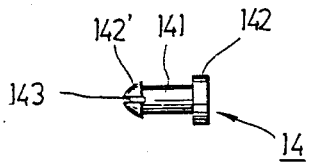
FIG. 5 is an elevational view showing the pin of the modular box spring mattress according to this invention.

Referring to FIG. 4, the looped portion 111 of one insertion member 11 of a plate unit 10, other than those distributed along the peripheries of the plate units 1, is inserted through the retaining hole 121 of one coupling seat 12 of an adjacent plate subunit 10 so as to form a pin hole 13 between the looped portion 111 of the insertion member 11 and the coupling seat 12. As shown in FIG. 5, a plastic pin 14 is inserted through the pin hole 13 so as to retain the insertion member 11 on the coupling seat 12. In this way, the plate subunits 10 can be joined together to form the plate units 1.

Referring to FIG. 5, each of the pins 14 has a cylindrical body 141, a disk-like end 142 and a tapered end portion 142'. Both the diameter of the disk-like end 142 and the greatest diameter of the tapered end portions 142 are slightly greater than the diameter of the pin hole 13. The tapered end portion 142' has an open-ended slot 143 so that the pin 14 can be forcibly inserted through the pin hole 13. After the tapered end portion 142' of the pin 14 has been passed through the pin hole 13, the tapered end portion 142' returns to the original position so that the pin 14 can be retained within the looped portion 121 of the coupling seat 12, thereby joining the plate subunits 10 together.

Figure 6:
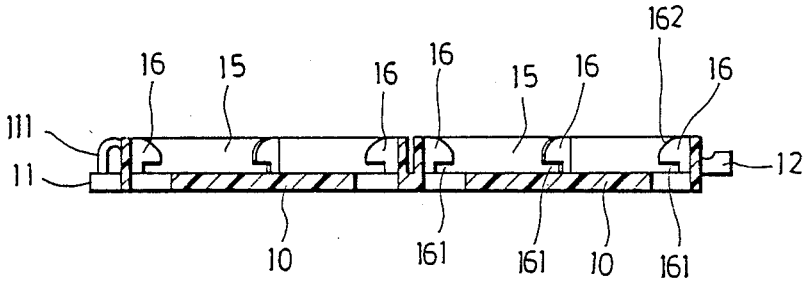
FIG. 6 is a sectional view taken along line VI—VI in FIG. 2.

Referring to FIGS. 2 and 6, each of the plate subunits 10 has eight spring-retaining circular areas 15 each of which includes a vertically extending circular flange 17, and five retaining arms 16 extending inwardly from the flange 17 at an angle of about 45 degrees in a plane parallel to the plate subunit 10. Referring to FIG. 6, each of the retaining arms 16 has a tapered end portion 162 which is spaced apart from the plate subunit 10 so as to form a spring-accommodating space 161 between the retaining arm 16 and the plate subunit 10. In assembly, one spring 2 is pushed into the circular flange 17. The tapered end portions 162 of the retaining arms 16 can be pushed toward the flange 17 by either the lowermost turn 20 or the uppermost turn 21, (see FIG. 7), of the spring 2 so that the end turn of the spring 2 can enter the spring-accommodating spaces 161. Then, the tapered end portions 162 of the retaining arms 16 return resiliently to the original position. The spring 2 is thus easily retained in the spring retaining area 15.

Figure 7:
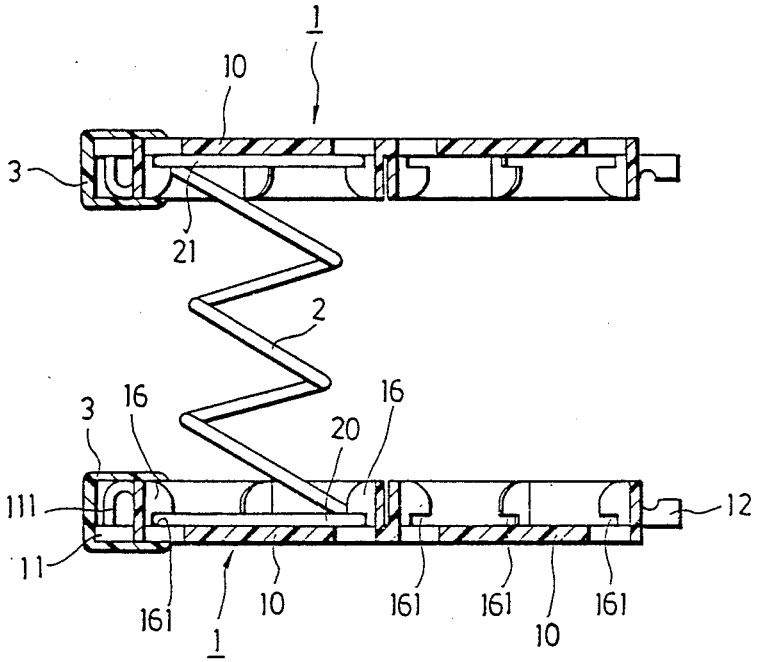
FIG. 7 is a sectional view taken along line VII—VII in FIG. 1.

Referring to FIG. 7, each of the marginal strips 3 has a generally U-shaped cross-section so that the insertion members 11 and the coupling seats 12 provided along the peripheries of the plate units 1 are inserted tightly into the strips 3.

With this invention thus explained, it is apparent that numerous modifications and variations can be made without departing from the scope and spirit of this invention. It is therefore intended that this invention be limited only as indicated in the appended claims.

I claim:

1. A modular box spring mattress comprising two flexible plate units having a spring unit disposed between said plate units for biasing said plate units away from each other, said spring unit including a plurality of coiled compression springs and one of said flexible plate units comprising:

a plurality of plate subunits joined together side by side defining at least one of the flexible plate units, each plate subunit having a substantially rectangular configuration and including a plurality of pins and a plurality of retaining holes formed along two adjacent sides thereof, a plurality of insertion members secured to the remaining adjacent sides thereof, said insertion members including a looped portion generally perpendicular to said subunits for insertion through said retaining holes in a side of an adjacent subunit so as to form a pin hole in an end portion of each of said looped portions, said pins being inserted through said pin holes so as to retain said subunits together;

a plurality of annular flanges extending from each plate unit towards each other, said annular flanges of one of said plate units opposing said annular flanges of the other plate unit so that end turns of said compression springs are receivable within said annular flanges;

a plurality of flexible retaining arms extending obliquely and inwardly from each of said annular flanges in a plane generally parallel to said plate subunits, the angle formed at the tangent of each flexible retaining arm and its respective annular flange being approximately 45°, said flexible retaining arms including end portions spaced apart from its corresponding plate subunits so that said end turns of said compression springs can be respectively retained between said flexible retaining arms and said plate subunits.

2. The modular box spring mattress as claimed in claim 1 wherein said flexible retaining arms are resiliently biased to assume said angle of 45°.

3. The modular box spring mattress as claimed in claim 1 wherein the angle formed at the tangent of each flexible retaining arm is 45° when said compression springs are received within said annular flanges and when said compression springs are removed from said annular flanges.

4. The modular box spring mattress as claimed in claim 1 wherein said flexible retaining arms comprise a curved configuration.

5. The modular box spring mattress as claimed in claim 1 wherein said subunits are separable from each other.

6. The modular box spring mattress as claimed in claim 1 wherein each of said pins is made of a flexible material and has two enlarged end portions having a diameter slightly greater than the diameter of said pin holes, one of said enlarged end portions being tapered and having an open-ended slot formed in an end surface thereof such that said tapered end portions of said pins can be forcible inserted through said pin holes of said insertion members.

7. A modular box spring mattress as claimed in claim 1, wherein each of said retaining arms is tapered and has an inclined side remote from its corresponding subunit, whereby, said compression springs can be respectively inserted between said retaining arms and said subunits.

* * * * *